US010060700B2

(12) United States Patent
Gellert

(10) Patent No.: US 10,060,700 B2
(45) Date of Patent: Aug. 28, 2018

(54) RIFLE SLING BUCKLE ASSEMBLY

(71) Applicant: Apex-Pred, L.L.C., Cocoa Beach, FL (US)

(72) Inventor: D. Mark Gellert, Southern Pines, NC (US)

(73) Assignee: APEX-PRED, L.L.C., Cocoa Beach, FL (US)

( * ) Notice: Subject to any disclaimer, the term of this patent is extended or adjusted under 35 U.S.C. 154(b) by 0 days.

(21) Appl. No.: 14/925,819

(22) Filed: Oct. 28, 2015

(65) Prior Publication Data

US 2016/0123698 A1 May 5, 2016

Related U.S. Application Data

(60) Provisional application No. 62/072,276, filed on Oct. 29, 2014.

(51) Int. Cl.
*F41C 33/00* (2006.01)
*F41C 23/02* (2006.01)

(52) U.S. Cl.
CPC ..... *F41C 33/002* (2013.01); *F41C 23/02* (2013.01)

(58) Field of Classification Search
CPC ..... F41C 33/002; F41C 23/02; F41C 23/14; F41C 23/16
USPC ..... 224/150, 913, 257–258, 271–272, 558; 42/85; D22/108
See application file for complete search history.

(56) References Cited

U.S. PATENT DOCUMENTS

| | | | | |
|---|---|---|---|---|
| 4,716,630 | A * | 1/1988 | Skyba | F16G 11/106 24/134 KB |
| 6,425,561 | B2 * | 7/2002 | Wooten | F41G 1/35 248/229.1 |
| 6,598,330 | B2 * | 7/2003 | Garrett | F41C 23/02 224/150 |
| 6,868,587 | B2 * | 3/2005 | Rard | A44B 11/125 24/170 |
| 8,091,265 | B1 * | 1/2012 | Teetzel | F41C 23/16 42/124 |
| D694,845 | S * | 12/2013 | Satzinger | D22/108 |
| D697,160 | S * | 1/2014 | Satzinger | D22/108 |
| 9,573,268 | B2 * | 2/2017 | Azhocar | B25G 1/06 |
| 2006/0048431 | A1 * | 3/2006 | Weir | F41C 23/02 42/85 |
| 2012/0280006 | A1 * | 11/2012 | Garrett | F41C 33/002 224/150 |

* cited by examiner

*Primary Examiner* — Adam Waggenspack
(74) *Attorney, Agent, or Firm* — Workman Nydegger

(57) ABSTRACT

Rifle sling buckle assemblies are configured to attach to a foregrip of a rifle for easy and effective rifle sling adjustment. A buckle element is configured to engage with a strap of a rifle sling and to prevent inadvertent loosening or detachment of the rifle sling. A mounting element is configured to attach the rifle sling buckle assembly to a foregrip of a rifle, providing easy access to a consistent adjustment point and allowing a user to efficiently adjust and manage the rifle sling.

16 Claims, 7 Drawing Sheets

RIFLE SLING BUCKLE ASSEMBLY

CROSS-REFERENCE TO RELATED APPLICATIONS

This application claims the benefit of and priority to U.S. Provisional Patent Application Ser. No. 62/072,276 filed on Oct. 29, 2014 and entitled "RIFLE SLING BUCKLE ASSEMBLY," and which application is expressly incorporated herein by reference in its entirety.

FIELD OF THE DISCLOSURE

The disclosure relates generally to buckles configured for selectably engaging with a strap or strap-like structure, and that are configured to be selectably fastened to or mounted to a rifle.

BACKGROUND

Rifles are often fitted with shoulder straps or slings to facilitate transport and carrying of the rifle. Such slings are typically attached to a rifle at two attachment points, and such slings may include a variety of clips and buckles for adjusting the overall length of the sling. While such an approach is beneficial, there is an ongoing need for improved rifle sling buckles. In particular, rifle sling buckle assemblies capable of providing easy and reliable adjustment of the rifle sling size and/or length is desirable.

BRIEF SUMMARY

Embodiments of the present disclosure include a rifle sling buckle assembly configured in size and shape to be selectably connected to a rifle. Certain embodiments include a buckle element and a mounting element.

Certain embodiments include a mounting element or securing component configured to attach, secure, and/or fasten the rifle sling buckle assembly to the rifle or to a component of the rifle, thereby providing a consistent and easily accessible adjustment point enabling a user to easily adjust a rifle sling.

In certain embodiments, the mounting member is configured to secure the buckle assembly to a foregrip of a rifle, such as a tactical free-floating foregrip. Certain embodiments are configured to attach to a rail of the foregrip, such as an integral rail formed as part of the foregrip or a separate and selectably attachable auxiliary or accessory rail. Certain embodiments include mounting elements configured to attach to rails constructed according to military and/or industry specifications, such as MIL-STD-1913 specifications, Weaver rail mount specifications, NATO Accessory Rail specifications, and/or other standardized rail integration systems.

Certain embodiments include attachment means or mounting elements that include adjustable clasps configured to allow a user to alter a distance between the clasps, for example, during attachment and/or removal of the buckle assembly. The adjustably spaced clasps may then be locked into position when desired (e.g., when the buckle assembly has been placed at a desired location on a rifle) by a locking screw or other fastening and locking means.

The buckle element may include a quick-release type buckle, for example, and the quick-release buckle can be configured in size and shape to engage with a strap, belt, or other portion of a rifle sling.

Certain embodiments include a buckle element or clamping member configured to engage, clamp, brace, and/or stop a strap or similar structure from slipping or moving through the buckle assembly and inadvertently loosening a rifle sling or detaching the rifle sling form a rifle. In certain embodiments, a buckle element allows the strap or strap-like structure to move in one direction (e.g., a direction that tightens the rifle sling), but prevents the strap or strap-like structure from moving in another direction (e.g., a direction that loosens or detaches the rifle sling). Certain embodiments include a release mechanism configured to allow a user to selectably disengage the buckle from the strap to allow the user to adjust the positioning of the strap within the buckle assembly and/or to tighten or loosen the fit of the rifle sling.

Other aspects and advantages of the invention will be apparent from the following description and the appended claims. The various characteristics described above, as well as other features, will be readily apparent to those skilled in the art upon reading the following detailed description, and by referring to the accompanying drawings. This summary is therefore not intended to identify key or essential features of the claimed subject matter, nor is it intended to be used as an aid in limiting the scope of the claims.

BRIEF DESCRIPTION OF THE DRAWINGS

In order to describe various features and concepts of the present disclosure, a more particular description of certain subject matter will be rendered by reference to specific embodiments which are illustrated in the appended drawings. While each embodiment contemplated hereby may not be drawn to scale, at least some of the appended drawings may be drawn to scale. Understanding that these drawings depict just some example embodiments and are not to be considered to be limiting in scope, various embodiments will be described and explained with additional specificity and detail through the use of the accompanying drawings in which.

DETAILED DESCRIPTION

The following is directed to various embodiments of the disclosure. The embodiments disclosed should not be interpreted, or otherwise used, to limit the scope of the disclosure including the claims. In addition, those having ordinary skill in the art will appreciate that the following description has broad application, and the discussion of any embodiment is not intended to suggest that the scope of the disclosure, including the claims, is limited to that embodiment.

Certain terms are used throughout the following description and claims to refer to particular features or components. As those having ordinary skill in the art will appreciate, different persons may refer to the same feature or component by different names. This document does not intend to distinguish between components or features that differ in name but not function. Certain features and components herein may be shown exaggerated in scale or in somewhat schematic form and some details of conventional elements may not be shown or described in interest of clarity and conciseness. Where the claims or description refer to "a," "an," and/or "the" element, such reference is not be construed that there is just one of that element, but is instead to be inclusive of other components and is understood as "one or more" of the element, unless the context clearly indicates otherwise.

Figure 1:
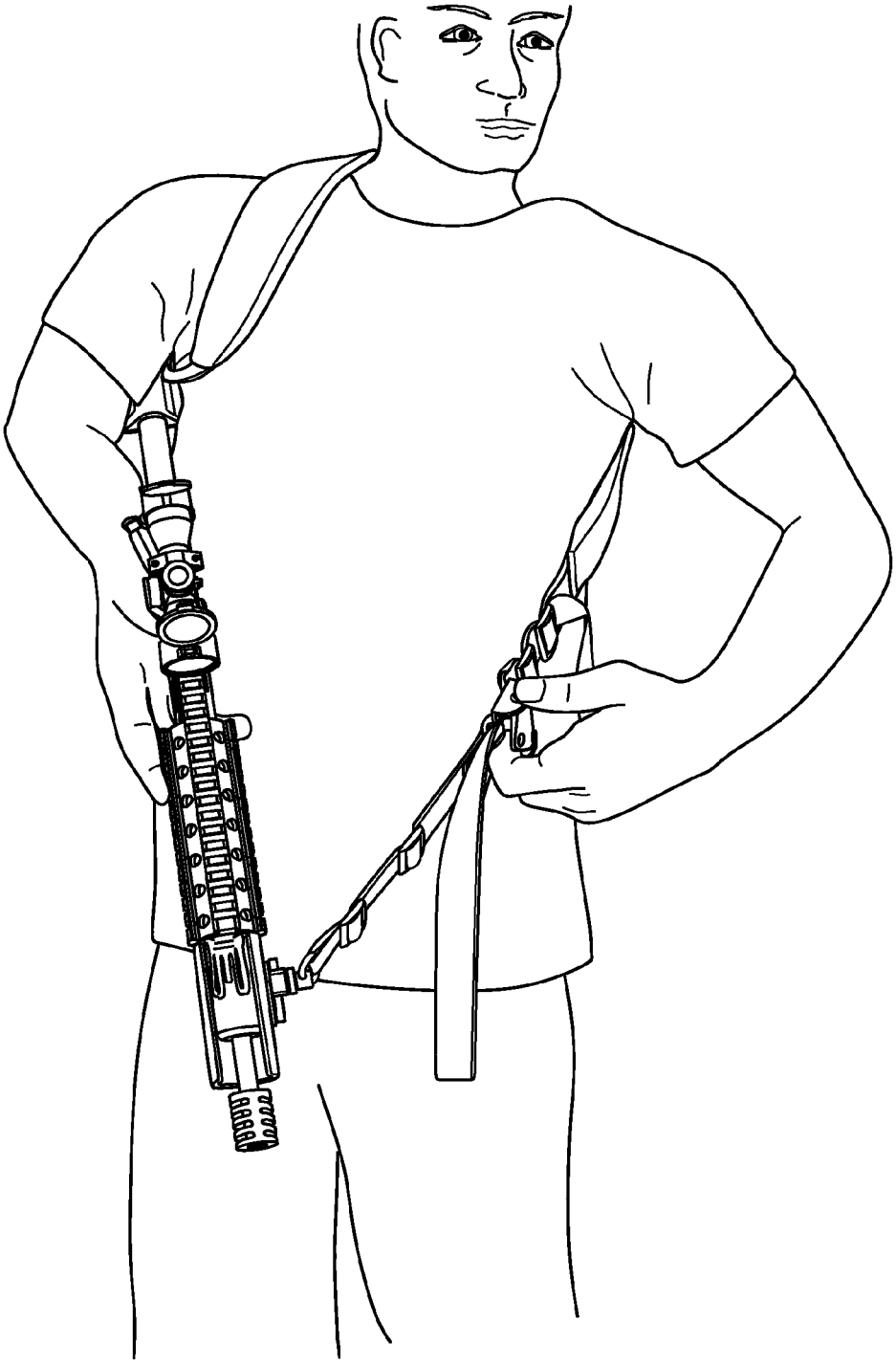
FIG. 1 (Prior Art)
FIG. 1 illustrates a typical rifle sling as worn by a user.

FIG. 1 illustrates a typical rifle sling as worn by a user. To make adjustments to the length of the rifle sling, a user must locate a buckle or clip at an adjustment point on the rifle sling, a point which may slide or move to different relative locations depending on the adjusted length and configuration of the rifle sling and depending on how the rifle sling is worn and/or shifts during use.

Figure 2:
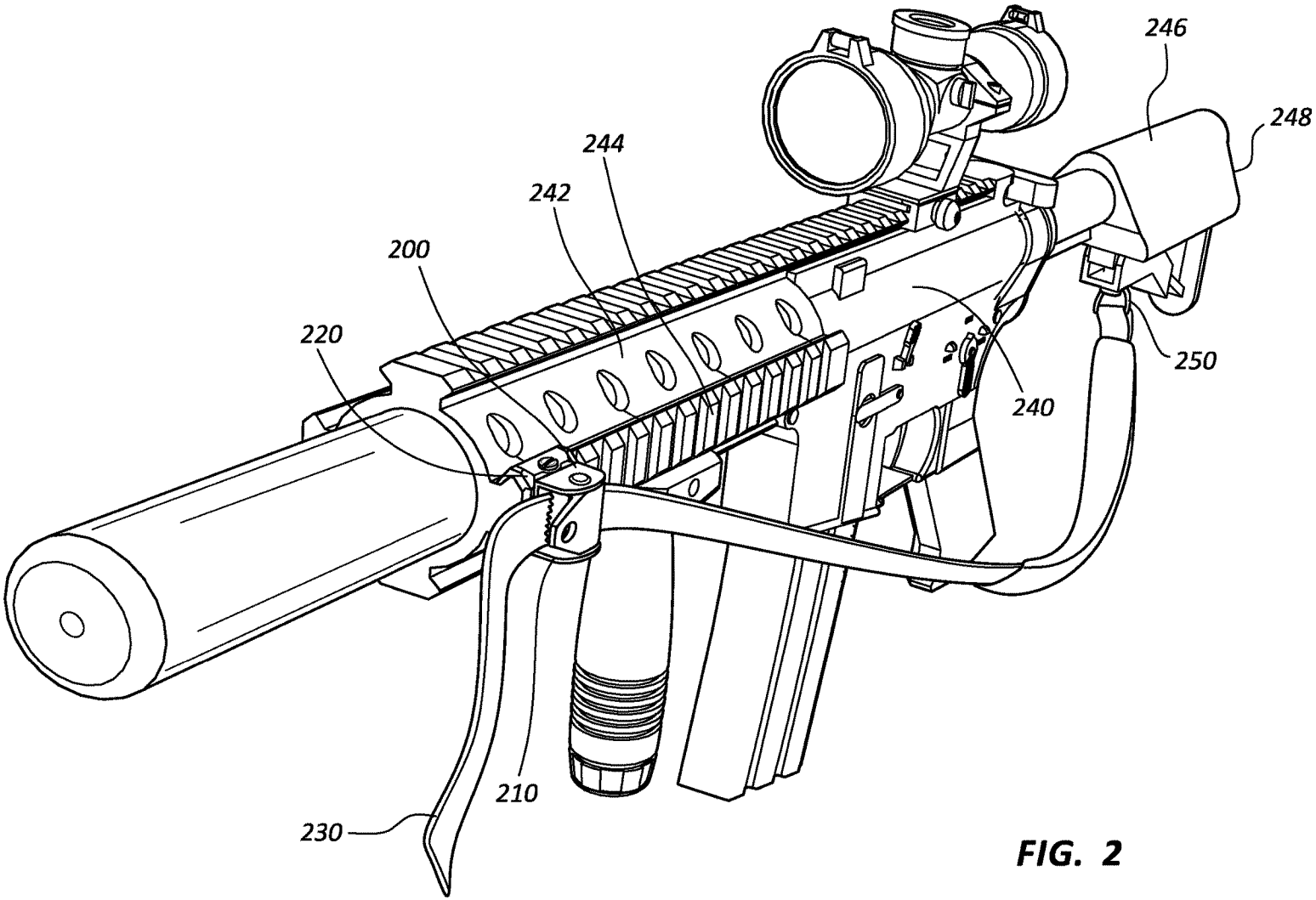
FIG. 2 illustrates an embodiment of a rifle sling buckle assembly according to the present invention attached to a foregrip of a rifle and engaged with a strap of a rifle sling.

FIG. 2 illustrates one embodiment of a rifle sling buckle assembly 200 of the present invention. In the illustrated embodiment, the rifle sling buckle assembly 200 includes a buckle element 210, and a mounting element 220 coupled to the buckle element 210. The buckle element 210 is configured to selectably engage with a strap 230. The mounting element 220 is also configured to selectably attach to a rifle 240, thereby providing a consistent adjustment point and enabling a user to quickly find the adjustment point and efficiently adjust the rifle sling.

The buckle element 210 and the mounting element 220 may be joined by welding, adhesives, or with other fasteners (e.g., bolts, nuts, rivets). In some embodiments, the buckle element 210 and the mounting element 220 may be integrally formed as one piece. For example, at least a portion of the buckle element 210 and at least a portion of the mounting element 220 may be cast or molded as one piece.

The rifle sling buckle assembly 200 may be formed from a variety of materials or combinations of materials, including metals (e.g., aluminum, stainless steel), and plastics.

In the embodiment shown in FIG. 2, the buckle element 210 is configured to engage with the strap 230 and prevent the strap 230 from loosening and/or sliding out of the buckle element 210 (as discussed in greater detail below). In this embodiment, the buckle element 210 is a quick-release buckle configured to securely engage with the strap 230 when the buckle element 210 is in a closed or secured position, and to disengage with the strap 230 when the buckle element 210 is moved into an open or released position. In the illustrated embodiment, the quick-release buckle element 210 is configured to automatically reset to a closed or secure position when not actively forced into an open or released position.

In other embodiments, the buckle element 210 may include other types of buckles, hooks, rings, loops, slides, latches, and the like. For example, the buckle element may include other types of buckles, such as tourniquet buckles or corset buckles, or may include pivot bar buckles.

FIG. 2 illustrates a strap 230 passed through and engaged with the buckle element 210. In other embodiments, the buckle element 210 may be configured to associate with and secure other types of structures such as ropes, belts, cords, and other strap-like structures. Additionally, FIG. 2 illustrates the strap 230 running from the rifle sling buckle assembly 200 to an anchor 250 mounted to another point on the rifle 240. In the illustrated embodiment, the anchor 250 is located on the underside of the stock 246 of the rifle 240. In other embodiments, the anchor 250 may be located at other portions of the rifle 240, including other portions of the stock 246 of the rifle 240 (e.g., top, right, or left sides), or portions of the butt 248 of the rifle 240. In the illustrated embodiment, the anchor 250 includes a loop 252 for connecting the strap 230. In other embodiments, the anchor 250 may include other attachment means, such as rings, hooks, slides, latches, and/or buckles (e.g., quick-release, tourniquet, corset, pivot bar).

The mounting element 220 of the illustrated embodiment is configured to be mounted to a foregrip 242 of the rifle 240. As used herein, the term "foregrip" also includes the synonymous terms "handguard," "forearm assembly," "rail assembly," and "grip," as well as other components and structures attached to a barrel or other forward portion of a rifle or otherwise attached to or integrated with the barrel of a rifle. In preferred embodiments, the foregrip 242 is a free-floating foregrip. In other embodiments, the foregrip 242 is a non-free-floating foregrip, such as a drop-in foregrip.

In the specific embodiment shown, the mounting element 220 is mounted to the foregrip 242 by attaching to a rail 244 of the foregrip 242. The rail 244 may be an integrated part of the foregrip 242, or may be an accessory rail separately attached (e.g., bolted, welded, adhered, or otherwise fastened) to the foregrip 242. The rail 244 may be any rail of a foregrip 242. For example, in embodiments including quad rail foregrips, such as the illustrated foregrip, the mounting element 220 may be mounted to any of the rail sections of the foregrip 242 (e.g., top, bottom, right, or left rail).

Additionally, or alternatively, the mounting element 220 may be mounted to any of the rails of other types of foregrips (e.g., single-rail foregrips, or foregrips with two, three, or more than four rails). In other embodiments, the mounting element 220 may be mounted to any separately attachable rails attachable to any type of foregrip, including flat rails and offset rails, such as rails configured to provide an offset of 15, 30, 45, 60, 75, or 90 degrees, for example.

The mounting element 220 may be configured to attach to a rail 244 with a standardized mounting platform, such as a rail 244 conforming to MIL-STD-1913 specifications (also known as Picatinny specifications), Weaver rail mount specifications, NATO Accessory Rail specifications, and/or other standardized rail integration systems.

Figure 3:
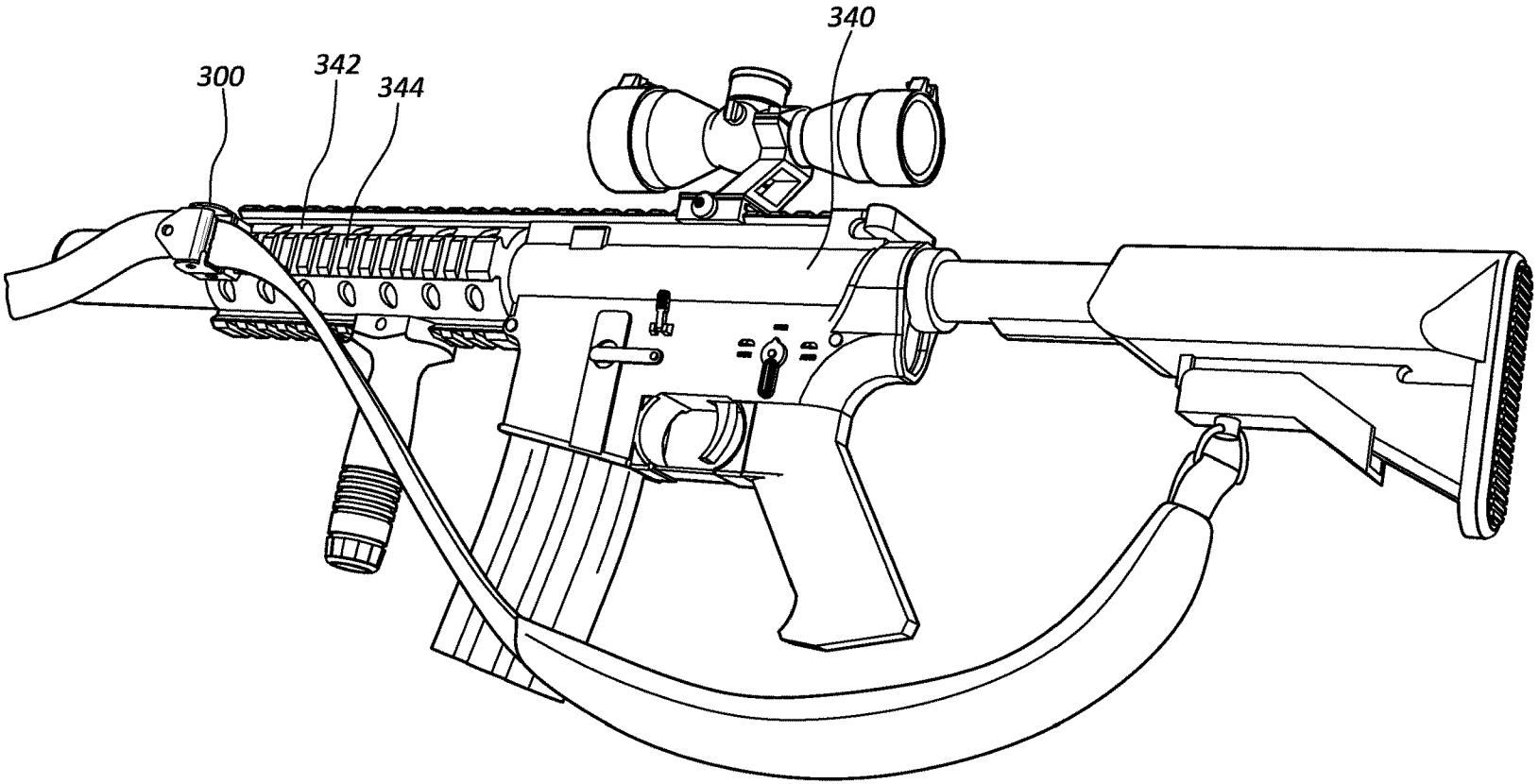
FIG. 3 illustrates another view of an embodiment of a rifle sling buckle assembly according to the present invention attached to a foregrip of a rifle and engaged with a strap of a rifle sling.

FIG. 3 illustrates another view of a rifle sling buckle assembly 300 attached to a rifle 340 by attaching to a rail 344 of a foregrip 342.

Figure 4:
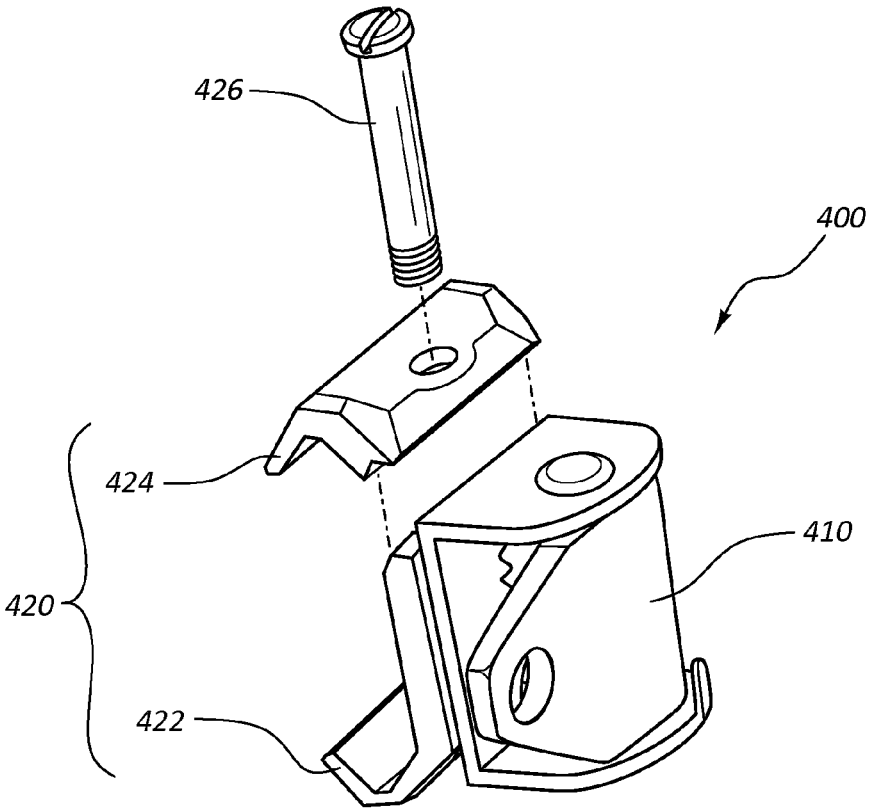
FIG. 4 illustrates an exploded view of an embodiment of a rifle sling buckle assembly including a first clasp, a second clasp, and a locking screw.

FIG. 4 illustrates an exploded view of a rifle sling buckle assembly 400 including a buckle element 410 and a mounting element 420. The mounting element 420 includes a first clasp 422, a second clasp 424, and a locking screw 426 configured to join the first clasp 422 and the second clasp 424. The first clasp 422 includes a threaded hole (not shown; see FIGS. 6 and 7) for receiving the threaded portion of the locking screw 426. The first clasp 422 and the second clasp 424 are configured in size and shape such that the second clasp 424 may be detachably connected to the first clasp 422 by removing and inserting the locking screw 426. Additionally, the distance between the first clasp 422 and the second clasp 424 is selectably adjustable, and can be adjusted to be greater or shorter by unscrewing or further screwing the locking screw to untighten or tighten the connection of the second clasp 424 to the first clasp 422.

Figure 5:
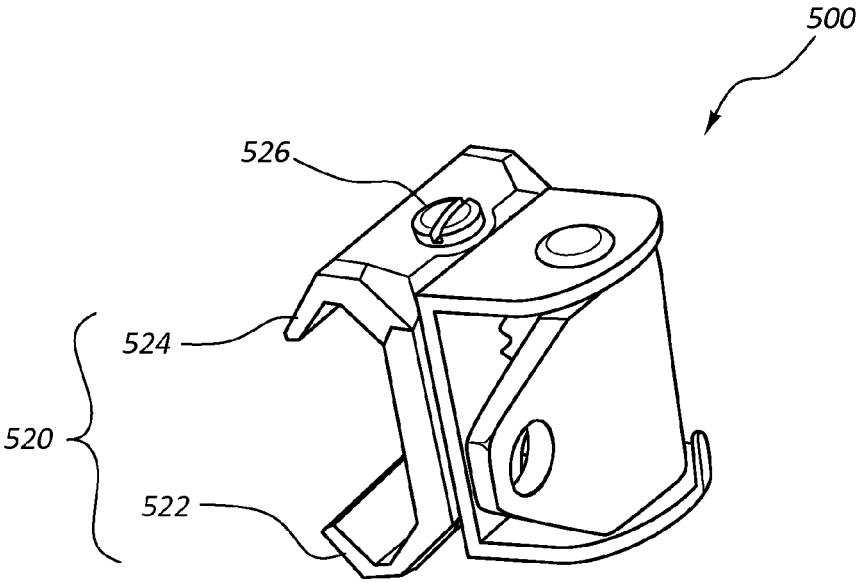
FIG. 5 illustrates an embodiment of a rifle sling buckle assembly in a locked or secured configuration.

FIG. 5 illustrates a rifle sling buckle assembly 500 with a mounting element 520 including a second clasp 524 fully joined to and tightened against a first clasp 522 by a locking screw 526. Though the illustrated embodiments include a locking screw 526, other embodiments may include other fasteners and/or other means of attaching a first clasp 522 to a second clasp 524. For example, nails, rivets, clamps, pins, rings (e.g., snap rings) and/or nuts (e.g. adjustable tension nuts) or other fasteners may be used.

The illustrated embodiment shows a mounting element 520 including a second clasp 524 that is fully separable from the first clasp 522. In other embodiments, the mounting element 520 may include a second clasp that is partially or fully joined to the first clasp, or is only partially separable from the first clasp. For example, some embodiments may include clasps configured as one integral piece, or one or more clasps configured to pivot from an open position to a closed position about a hinge or other pivot axis.

The illustrated embodiment shows a mounting element including a first clasp 522 and a second clasp 524. In other embodiments, the mounting element 520 may include more than two clasps. For example, some embodiments may include multiple clasps extending from each side of the mounting element 520. Other embodiments may include only one clasp, and other embodiments may omit clasps, being directly fastened to a rail or other component of a rifle through other securing means (e.g., bolting, welding, and/or adhesives). Yet other embodiments of rifle sling buckle assemblies may be integrally formed with a rifle component. For example, in some embodiments, at least a portion of a rifle sling buckle assembly (e.g., a mounting element) may be formed together with a foregrip during formation of the foregrip, after which other portions (e.g., a buckle member) may be attached.

Figure 6:
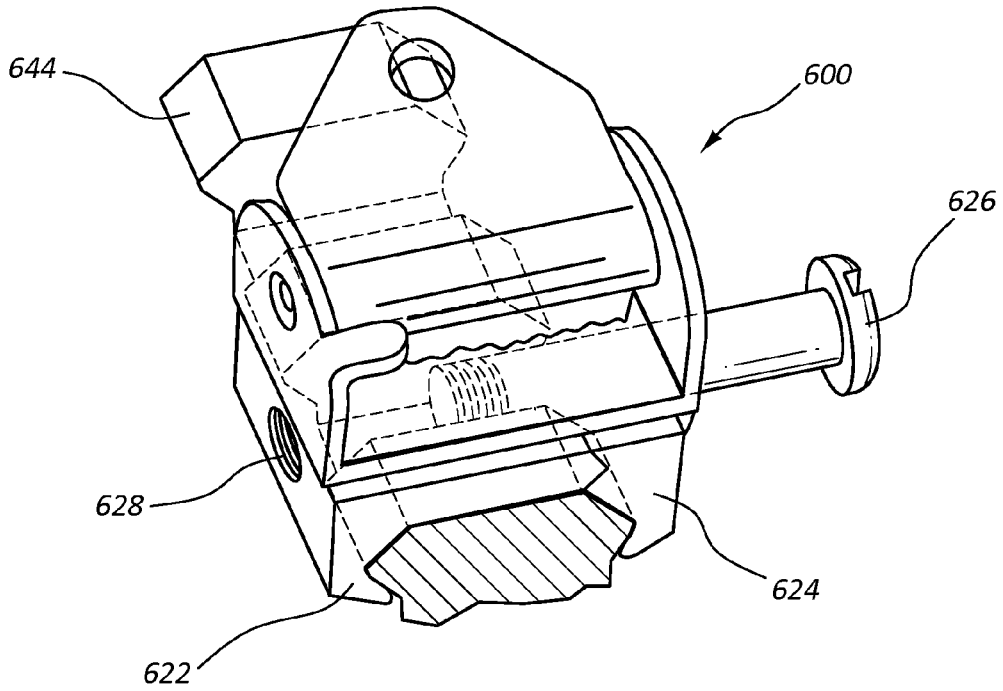
FIG. 6 illustrates an embodiment of a rifle sling buckle assembly during attachment to or detachment from a rail.

FIG. 6 illustrates a rifle sling buckle assembly 600 being attached to a rail 644. As discussed above, the rail 644 may be an integrated part of a railed foregrip, or may be a separate rail (e.g., a separately attachable accessory rail) attachable to a foregrip. As illustrated in the Figure, a locking screw 626 is configured to pass through a second clasp 624 and into a threaded portion 628 of the first clasp 622, thereby locking the first clasp 622 and second clasp 624 into a tightened or locked position on the rail 644.

Figure 7:
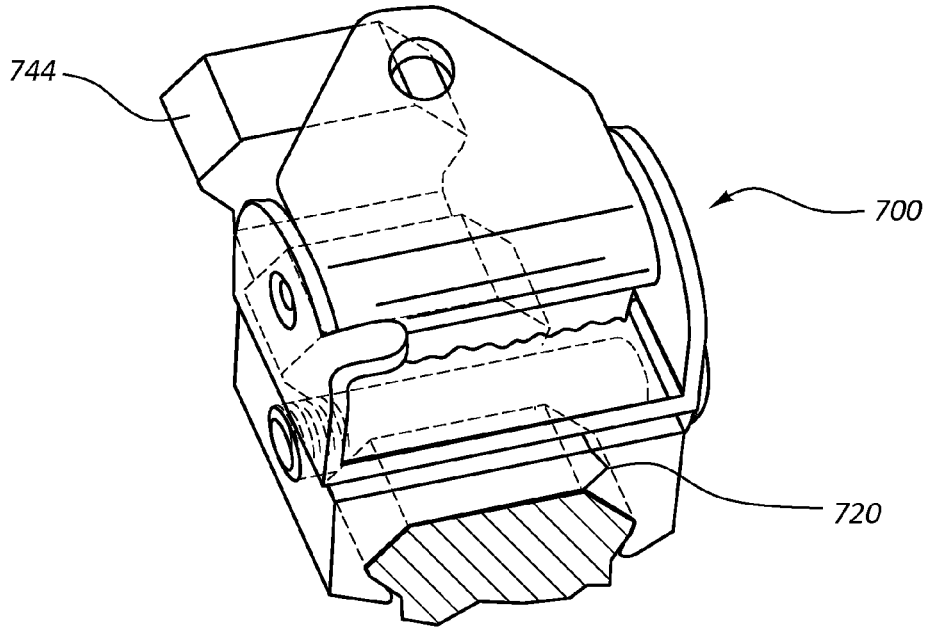
FIG. 7 illustrates an embodiment of a rifle sling buckle assembly attached to a rail.

FIG. 7 illustrates a rifle sling buckle assembly 700 locked into position upon a rail 744. As the Figure illustrates, the mounting element 720 is configured to match the rail 744 for easy attachment and detachment of the rifle sling buckle assembly 700. As discussed above, in other embodiments, the rifle sling buckle assembly may be attached to a rifle at a different location and/or upon a different rifle component or attachment (e.g., attachment to stock, butt, or rifle barrel). In such embodiments, the mounting element 720 and/or the buckle element may be configured to match the different rifle component or attachment.

Figure 8A:
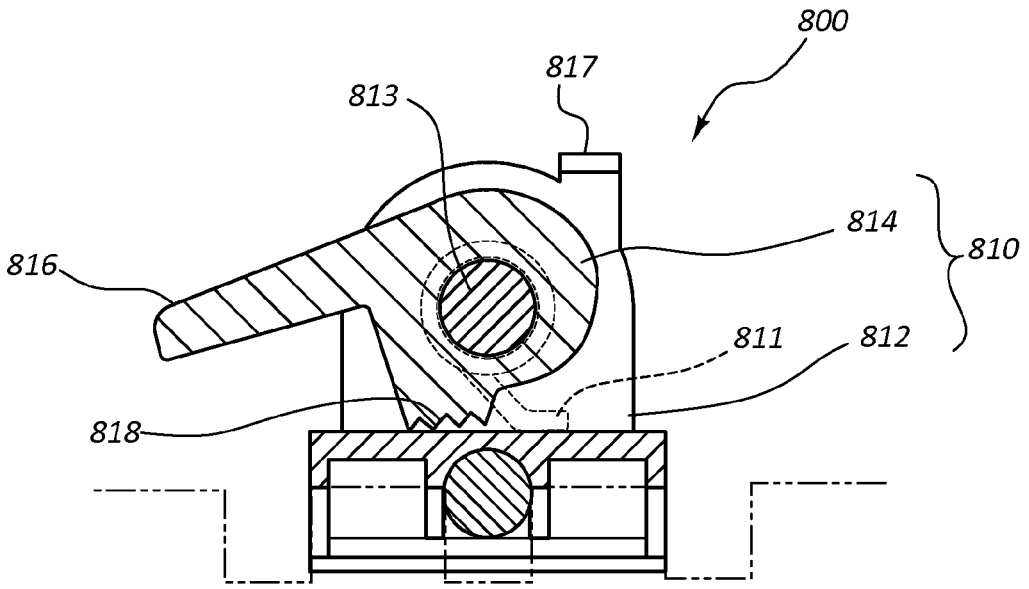
FIG. 8A illustrates a cutaway view of a rifle sling buckle assembly showing a quick-release type buckle element.
Figure 8B:
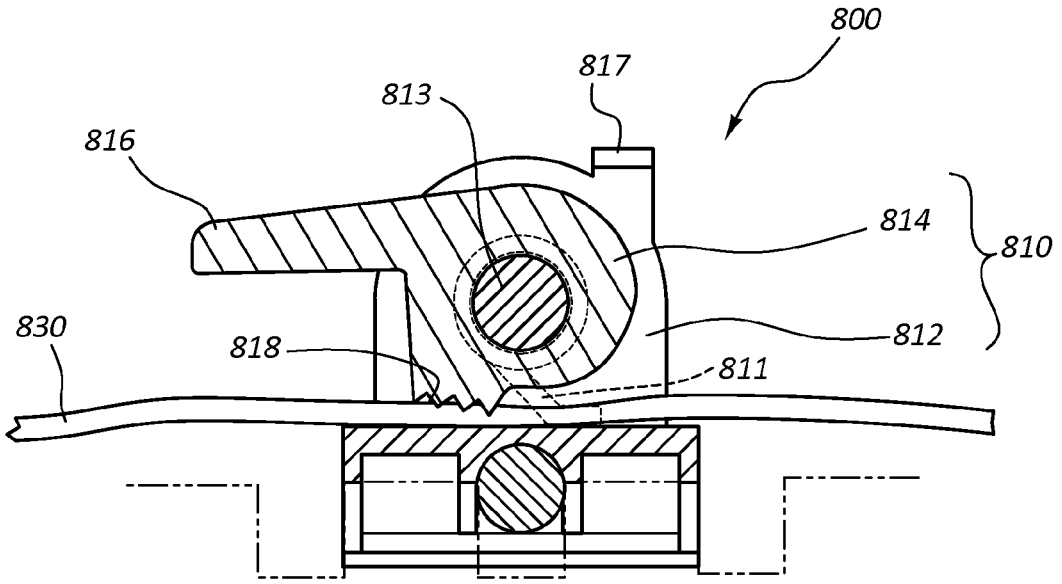
FIG. 8B illustrates a cutaway view of a rifle sling buckle assembly showing a quick-release type buckle element engaged with a strap that has been positioned within the buckle element.

FIG. 8A illustrates a cutaway view of a rifle sling buckle assembly 800 including a quick-release type buckle element 810. FIG. 8B illustrates a cutaway view of the buckle element 810 engaged with a strap 830 that has been passed through and positioned within the buckle element 810. In the illustrated embodiment, the buckle element 810 includes a base 812 and a clamping portion 814. The clamping portion 814 includes a release handle 816, a clamping surface 818, and a spring 811. The spring 811 is configured to force the clamping portion 816 into a closed position, bringing the clamping surface 818 into contact against the base 812 or a portion of the strap 830 that has been passed through and positioned within the buckle element 810.

Additionally, the clamping portion 814 is configured to restrict and prevent movement of the strap 830 in a proximal direction (away from the release handle 816). For example, movement of the strap 830 in a proximal direction will cause the strap 830 to catch against and pull the clamping surface 818, thereby causing the entire clamping portion 814 to pivot about a pin 813 even further into a closed position, pressing the clamping surface 818 tighter against the strap 830. In this manner, the buckle element 810 may be configured to prevent inadvertent loosening or detachment of the strap 830 from the buckle element 810.

In this embodiment, the release handle 816 is configured such that a user may lift the release handle 816 to move (e.g., pivot) the clamping portion 814 into a position wherein the clamping surface 818 is spaced apart from the base 816, thereby allowing a strap 830 to slide along the base 812 and/or move through the buckle element 810. In this embodiment, the buckle element 810 also includes a stop 817 to abut the release handle 816 against during release and to prevent the release handle 816 from overextending (see also FIGS. 6 and 7). Upon release of the release handle 816, the spring 811 resiliently forces the clamping portion 816 back to a closed position, bringing the clamping surface 818 into contact with the base 812 or with a portion of the strap 830 positioned within the buckle element 810.

The illustrated embodiment shows a clamping portion 814 configured to pivot around a pin 813 when moving between open and closed positions, the spring 811 configured to resiliently force the clamping surface 818 of the clamping portion 816 down. In other embodiments, the clamping portion may move in a linear fashion between open and closed positions, or may move with a combination of linear and rotational movements.

The illustrated embodiment shows a clamping surface 818 including a plurality of clamping teeth. Other embodiments may omit clamping teeth, or may include other patterns, projections, or other means of providing friction against a strap 830. Additionally, or alternatively, as discussed above, other embodiments of the buckle element 810 may include other types of adjustable fasteners or combinations of adjustable fasteners. For example, the buckle element may include loops, rings, slides, latches, or other types of buckles such as tourniquet, corset, and/or pivot bar buckles.

Figure 9A:
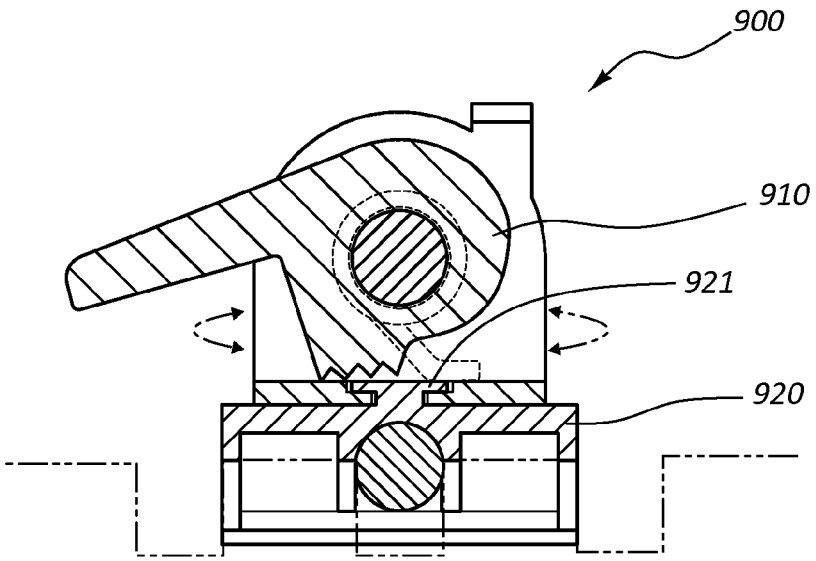
FIG. 9A illustrates a cutaway view of a rifle sling buckle assembly showing a quick-release type buckle element configured to swivel about a mounting element.
Figure 9B:
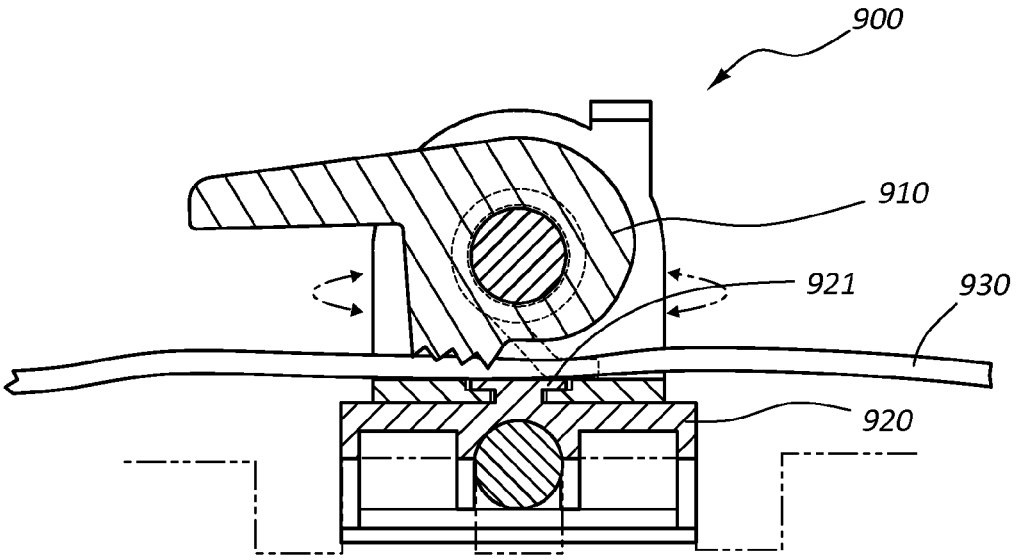
FIG. 9B illustrates a cutaway view of a rifle sling buckle assembly showing a quick-release type buckle element configured to swivel about a mounting element and engaged with a strap that has been positioned within the buckle element.

FIG. 9A illustrates a cutaway view of another embodiment of a rifle sling buckle assembly 900, and FIG. 9B illustrates a cutaway view of the rifle sling buckle assembly 900 engaged with a strap 930 that has been passed through and positioned within the buckle element 910. As illustrated in the Figures, the buckle element 910 is attached to the mounting element 920 at a swivel connector 921, allowing the buckle element 910 to swivel about the mounting element 920. For example, when a strap 930 is positioned within the buckle element 910 (as shown in FIG. 9B), the buckle element 910 may swivel upon the mounting element 920 to align the buckle element 910 with the position of the strap 930, such as when the strap moves during use.

In some embodiments, the pivoting buckle element 910 may be configured to freely swivel about the swivel connector 921. In other embodiments, the swivel connector 921 and the buckle element 910 may be include a locking means capable of locking the buckle element in place at a desired swivel angle.

The present invention may be embodied in other specific forms without departing from its spirit or essential characteristics. The described embodiments are to be considered in all respects only as illustrative and not restrictive. In fact, any combination of the features disclosed in any of the foregoing embodiments can be combined. The invention can incorporate any combination of the different features described herein, such that components and elements from one embodiment can be incorporated into or replace elements from any of the other embodiments described herein.

What is claimed is:

1. A rifle sling buckle assembly configured in size and shape to be selectably connected to a rifle and configured to engage with a strap, the rifle sling buckle assembly comprising:

a buckle element configured to selectably engage with a strap wherein the buckle element is a quick-release buckle that includes an opening for receiving the strap when the quick-release buckle is in an open position and a clamping surface configured for clamping onto the strap when the quick-release buckle is in a closed position;

a mounting element non-removably attached to the buckle element, the mounting element configured to be selectably attachable to a rail connected to a free-floating foregrip of a rifle by a threaded connector, the mounting element having a first clasp with a first unthreaded hole passing completely therethrough and a second clasp separable from the first clasp and having a threaded hole passing completely therethrough, wherein the buckle element includes a first lateral wall and a second lateral wall, the first lateral wall being parallel to a first sidewall of the first clasp upon which the first unthreaded hole is situated, and the second lateral wall being parallel to a second sidewall of the second clasp upon which the threaded hole is situated; and selectable attachment of the mounting element to the rail occurring while the first clasp and the second clasp are positioned on opposing sides of the rail and by threading a threaded end of the threaded connector into the threaded hole of the second clasp while an unthreaded portion of the threaded connector remains positioned in the first unthreaded hole of the first clasp.

2. The rifle sling buckle assembly of claim 1, wherein a distance between the first clasp and the second clasp is selectably adjustable.

3. The rifle sling buckle assembly of claim 2, wherein the locking screw is configured to adjust and/or lock a relative positioning of the first clasp and the second clasp.

4. A rifle sling buckle assembly configured in size and shape to be selectably connected to a free floating grip of a rifle and configured to engage with a strap, the rifle sling assembly comprising:

a quick-release buckle element configured to selectably engage with a strap, the quick-release buckle element including an opening for receiving the strap when the quick-release buckle is in an open position and a clamping surface configured for clamping onto the strap when the quick-release buckle is in a closed position;

an attachment system consisting of:

a mounting element non-removably attached to the quick-release buckle element, the mounting element comprising a first clasp and a second clasp separable from the first clasp and disposed opposite the first clasp, the first clasp and the second clasp configured in size and shape to selectably engage with a rail of a free floating grip of a rifle, the first clasp having a first hole that is unthreaded and that passes completely through outer and inner sides of the first clasp and being centrally positioned on the first clasp with respect to a full length of the outer side of the first clasp, the second clasp having a second hole passing completely through outer and inner sides of the second clasp and being centrally positioned on the second clasp with respect to a full length of the outer side of the second clasp; and a locking screw having a threaded end and a body, the locking screw being configured to engage with the mounting element and to adjust and/or lock the relative positions of the first clasp and the second clasp by threading the threaded end of the locking screw into the second hole while the body of the locking screw is positioned in the first hole;

wherein the quick-release buckle element includes a first lateral wall and a second lateral wall, the first lateral wall being parallel to a first sidewall of the first clasp upon which the first hole is situated, and the second lateral wall being parallel to a second sidewall of the second clasp upon which the second hole is situated.

5. The rifle sling buckle assembly of claim 4, further comprising the rifle, wherein mounting element is attached to the rail of the free floating grip of the rifle.

6. The rifle sling buckle assembly of claim 5, further comprising:

the strap, the quick release buckle element being selectably engaged with the strap.

7. A method of connecting a rifle sling buckle assembly to a rifle, the method comprising:

mounting a rifle sling buckle assembly, the rifle buckle assembly comprising a quick-release buckle element configured to selectably engage with a strap, the quick-release buckle element including an opening for receiving the strap when the quick-release buckle is in an open position and a clamping surface configured for clamping onto the strap when the quick-release buckle is in a closed position and a mounting element non-removably attached to the buckle element and a first clasp and a second clasp separable from the first clasp, wherein the quick-release buckle element includes a first lateral wall and a second lateral wall, the first lateral wall being parallel to a first sidewall of the first clasp upon which an unthreaded hole is situated, and the second lateral wall being parallel to a second sidewall of the second clasp upon which a threaded hole is situated, the rifle sling buckle assembly being directly mounted onto a free floating grip by at least:

inserting the first clasp of the rifle sling buckle assembly onto a first side of a rail of the free floating grip;

inserting the second clasp of the rifle sling buckle assembly onto a second side of a rail of the free floating grip; and inserting a locking screw through the unthreaded hole in the first clasp and into the threaded hole in the second clasp until a threaded end of the locking screw threadably engages the threaded hole in the second clasp, while an unthreaded portion of the locking screw passes through the unthreaded hole of the first clasp, and adjusting a relative position between the first clasp and the second clasp with the locking screw in order to secure and tighten the rifle sling buckle assembly to the rail of the free floating grip.

8. The method of claim 7, wherein the method further includes:

connecting strap to the rifle sling buckle assembly and to at least one of:

a rifle component of the rifle; or an additional rifle sling buckle assembly which is selectably attachable to the rifle component.

9. The method of claim 8, wherein the method further includes adjusting the strap by adjusting the position of the strap relative to the rifle sling buckle assembly.

10. The method of claim 7, wherein a relative distance between the first clasp and the second clasp is selectably adjustable.

11. The method of claim 10, wherein the locking screw is configured to adjust and secure the relative distance between the first clasp and the second clasp.

12. The rifle sling buckle assembly of claim 1, wherein the mounting element is welded to the buckle element so as to be further non-movably attached to the buckle element.

13. The rifle sling buckle assembly of claim 1, wherein the mounting element is molded or cast with the buckle element so as to be further non-movably attached to and integrally formed with the buckle element.

14. The rifle sling buckle assembly of claim 1, wherein the mounting element is movably attached to the buckle element with a swivel connector that allows the buckle element to swivel about the mounting element.

15. The rifle sling buckle assembly of claim 1, wherein the mounting element is selectably attachable to the rail by an attachment system consisting of only the threaded connector.

16. The rifle sling buckle assembly of claim 15, wherein the first unthreaded hole is centrally positioned between a front side and a back side of the of the first clasp and the threaded hole is centrally positioned between a front side and a back side of the second second clasp, such that the threaded connector is also centrally positioned between the front sides and back sides of the first and second clasps, respectively.

* * * * *